US007261072B2

(12) United States Patent
Schmitt

(10) Patent No.: US 7,261,072 B2
(45) Date of Patent: Aug. 28, 2007

(54) DEVICE FOR ALTERING THE CONTROL TIMES OF GAS EXCHANGE VALVES OF AN INTERNAL COMBUSTION ENGINE

(75) Inventor: Marco Schmitt, Fulda (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/244,729

(22) Filed: Oct. 6, 2005

(65) Prior Publication Data

US 2006/0075983 A1 Apr. 13, 2006

Related U.S. Application Data

(60) Provisional application No. 60/617,102, filed on Oct. 8, 2004.

(51) Int. Cl.
*F01L 1/34* (2006.01)

(52) U.S. Cl. ..... 123/90.15; 123/90.17; 123/90.12; 464/160

(58) Field of Classification Search ..... 123/90.12, 123/90.13, 90.15, 90.16, 90.17, 90.18; 464/1, 464/2, 160
See application file for complete search history.

(56) References Cited

U.S. PATENT DOCUMENTS 5,669,343 A * 9/1997 Adachi ..... 123/90.17
5,878,782 A * 3/1999 Nakajima ..... 137/625.65
6,443,112 B1 * 9/2002 Kinugawa ..... 123/90.17

* cited by examiner

*Primary Examiner*—Ching Chang
(74) *Attorney, Agent, or Firm*—Charles A. Muserlian

(57) ABSTRACT

The invention relates to a device (101) for altering the control times of gas exchange valves of an internal combustion engine, having a hydraulic actuating device (102) and a control valve (103). The device (101) according to the invention is provided with centre-position locking of a hydraulic actuating device (102). Furthermore, the device (101) according to the invention ensures that if an actuating unit (112) which governs the control valve (103) fails, the hydraulic actuating device (102) is locked in the central position and the locking is maintained until the actuating unit (112) is repaired. Furthermore, the device (101) according to the invention allows the internal combustion engine to be started in a locked position in a central position without a moveable element (105) of the hydraulic actuating device (102) striking a side wall of a pressure space (104) when the internal combustion engine is started.

15 Claims, 6 Drawing Sheets

DEVICE FOR ALTERING THE CONTROL TIMES OF GAS EXCHANGE VALVES OF AN INTERNAL COMBUSTION ENGINE

PRIOR APPLICATION

This application is based on provisional application Ser. No. 60/617,102 filed Oct. 8, 2004.

FIELD OF THE INVENTION

The invention relates to a device for altering the control times of gas exchange valves of an internal combustion engine In internal combustion engines, camshafts are used to actuate the gas exchange valves. Camshafts are arranged in such a manner in the internal combustion engine that cams arranged thereon bear against cam followers, for example bucket tappets, rocker levers or pivot levers. If a camshaft is set in rotation, the cams roll along the cam followers, which in turn actuate the gas exchange valves. Therefore, both the opening time duration and the opening amplitude, but also the opening and closing instants, of the gas exchange valves are defined by the position and shape of the cams.

Modern engine designs tend to design the valve mechanism to be variable. On the one hand, the valve lift and valve opening duration should be variable all the way through to individual cylinders being completely shut down. Concepts such as switchable cam followers or electrohydraulic or electrical valve actuating means are provided for this purpose. Furthermore, it has proven advantageous for it to be possible to influence the opening and closing times of the gas exchange valves while the internal combustion engine is operating. In this context, it is desirable in particular for it to be possible to influence the opening and closing instants of the intake and exhaust valves separately, in order, for example, to deliberately set a defined valve overlap. Setting the opening and closing instants of the gas exchange valves as a function of the current engine map region of the engine, for example of the current engine speed or the current load, allows the specific fuel consumption to be reduced, the exhaust-gas properties to be positively influenced, the engine efficiency, maximum torque and maximum power to be increased.

The variability of the valve control times which has been described is achieved by a change in the phase position of the camshaft relative to the crankshaft. The camshaft is generally drive-connected to the crankshaft via a chain drive, belt drive, gearwheel drive or similar drive concepts. A device for altering the control times of an internal combustion engine, also referred to below as a camshaft adjuster, which transmits the torque from the crankshaft to the camshaft, is arranged between the chain, belt or gearwheel drive, driven by the crankshaft, and the camshaft. This device is designed in such a manner that while the internal combustion engine is operating the phase position between crankshaft and camshaft is held reliably and, if desired, the camshaft can be rotated with respect to the crankshaft within a defined angular range.

In internal combustion engines with in each case one camshaft for the intake valves and the exhaust valves, these camshafts can each be equipped with a camshaft adjuster. As a result, the opening and closing instants of the intake and exhaust valves can be shifted in terms of time with respect to one another and the valve overlaps can be deliberately adjusted.

Modern camshaft adjusters are generally seated on the drive-side end of the camshaft. However, the camshaft adjuster may also be arranged on an intermediate shaft, on a component which does not rotate or on the crankshaft. It comprises a drive wheel which is driven by the crankshaft and maintains a fixed phase relationship with respect to the latter, an output part, which is drive-connected to the camshaft, and an adjustment mechanism which transmits the torque from the drive wheel to the output part. In the case of a camshaft adjuster which is not arranged on the crankshaft, the drive wheel may be designed as a sprocket, pulley or gearwheel and is driven by the crankshaft by means of a chain, belt or gearwheel mechanism. The adjusting mechanism may be operated electrically, hydraulically or pneumatically.

Two preferred embodiments of hydraulically adjustable camshaft adjusters are the so-called axial piston adjusters and rotary piston adjusters.

In the case of the axial piston adjusters, the drive wheel is connected to a piston and the latter is connected to the output part, in each case by way of oblique toothing sets. The piston divides a cavity formed by the output part and the drive wheel into two pressure chambers arranged axially with respect to one another. If pressure medium is now supplied to one pressure chamber while the other pressure chamber is connected to a tank, the piston moves in the axial direction. The axial movement of the piston is converted by the oblique toothing sets into a rotation of the drive wheel relative to the output part and therefore a rotation of the camshaft relative to the crankshaft.

A second embodiment of hydraulic camshaft adjusters is formed by what are known as rotary piston adjusters. In these adjusters, the drive wheel is rotationally fixedly connected to a stator. The stator and a rotor are arranged concentrically with respect to one another, the rotor being non-positively, positively or cohesively connected or joined, for example by means of a press fit, a screw connection or a welded join, to a camshaft, an extension of the camshaft or an intermediate shaft. A plurality of cavities, which are spaced apart from one another in the circumferential direction and extend radially outwards from the rotor, are formed in the stator. The cavities are delimited in a pressure-tight manner in the axial direction by side covers. A blade which is connected to the rotor and divides each cavity into two pressure chambers extends into each of these cavities. The phase of the camshaft relative to the crankshaft can be adjusted or held by targeted connection of the individual pressure chambers to a pressure-medium pump or to a tank.

To control the camshaft adjuster, sensors record the characteristic data of the engine, such as for example the load state and the engine speed. These data are fed to an electronic control unit, which after it has compared the data with an engine data map of the internal combustion engine controls the inflow and outflow of pressure medium to and from the various pressure chambers.

To adjust the phase position of the camshaft with respect to the crankshaft, in hydraulic camshaft adjusters one of the two pressure chambers, which act against one another, of a cavity is connected to a pressure-medium pump, while the other is connected to the tank. The supply of pressure medium to one chamber in combination with the removal of pressure medium from the other chamber moves the piston separating the pressure chambers in the axial direction, with the result that in axial piston adjusters the camshaft is rotated relative to the crankshaft by way of the oblique toothing sets. In the case of rotary piston adjusters, the application of pressure to one chamber and removal of pressure from the other chamber moves the blade and therefore directly rotates the camshaft with respect to the crankshaft. To maintain the phase position, both pressure chambers are either connected to the pressure-medium pump or disconnected both from the pressure-medium pump and from the tank.

The flows of pressure medium to and from the pressure chambers are controlled by means of a control valve, generally a 4/3-way proportional control valve. A valve housing is provided with in each case one port for the pressure chambers (working port), one port leading to the pressure-medium pump and at least one port leading to a tank. An axially displaceable control piston is arranged inside the valve housing, which is substantially hollow-cylindrical in form. The control piston can be moved axially into any position between two defined limit positions, counter to the spring force of a spring element, by means of an electromagnetic actuator. The control piston is also provided with annular grooves and control edges, with the result that the individual pressure chambers can be optionally connected to the pressure-medium pump or the tank. It is also possible to provide a position of the control piston in which the pressure-medium chambers are disconnected both from the pressure-medium pump and from the pressure-medium tank.

DE 100 64 222 A1 presents a device of this type. This is a device of rotary piston design. A stator which is drive-connected to the camshaft is mounted rotatably on a rotor which is rotationally fixedly connected to a camshaft. The stator is designed with recesses that are open towards the rotor. Side covers which delimit the device are provided in the axial direction of the device. The recesses are closed off in a pressure-tight manner by the rotor, the stator and the side covers and therefore form pressure spaces. Axial grooves, in which blades extending into the recesses are arranged, are formed in the outer lateral surface of the rotor. The blades are formed in such a manner that they divide the pressure spaces into in each case two pressure chambers which act against one another. Supplying or discharging pressure medium to or from the pressure chambers allows the phase position of the camshaft relative to the crankshaft to be optionally held or adjusted.

Two locking pins, which are subjected to a force in the direction of the rotor by means of a spring means, are arranged in the side covers. Grooves extending in the circumferential direction are formed in the end side of the rotor, which faces the locking pins. The grooves are arranged and formed in such a manner that in a defined central position both locking pins engage in in each case one groove if neither of the grooves is being supplied with pressure medium. In this case, each pin bears against a circumferential-side end of the respective groove. The rotor is therefore locked relative to the stator, preventing relative rotation. The pressure-medium chambers can be filled with pressure medium via first and second pressure-medium lines. If a first pressure-medium chamber is filled with pressure medium, an end face of a locking pin is also acted on by pressure medium. As a result, the corresponding pin is pressed into the receiving bore in the side cover, and it is possible for the rotor to be adjusted in one direction relative to the stator. In this case, the other groove, in which the other locking pin is still engaging, is designed in such a manner as to allow adjustment of the rotor from the central position up to a maximum extent. The adjustment of the rotor with respect to the stator takes place in a corresponding way in the other direction. The device is equipped with a compensation spring, one end of which is secured to the rotor and the other end of which is secured to the stator, and which compensates for the drag torque which the camshaft exerts on the rotor.

DE 198 53 670 A1 presents a control valve which is used to control the flow of pressure medium to the pressure chambers according to the current loading state of the internal combustion engine. The control valve comprises an actuating unit, a substantially hollow-cylindrical valve housing and a substantially hollow-cylindrical control piston, which is held axially displaceably within the valve housing. Two working ports, one inlet port and one outlet port are formed on the valve housing. The actuating unit may, for example, be an electromagnet which via a tappet push rod moves the control piston counter to the force of a spring by the application of a control current. The inlet port is connected to one of the two working ports and the tank port is connected to the respective other working port or the working ports are disconnected from the inlet and outlet ports, depending on the position of the control piston within the valve housing. As a result, pressure medium is fed to one pressure chamber while pressure medium is flowing out of the other pressure chamber, which brings about a change in the phase position of the camshaft with respect to the crankshaft.

One serious drawback of this control valve in combination with a camshaft adjuster with centre-position locking is the fact that in the unenergized state the pressure-medium port is connected to one of the two working ports. Therefore, if the actuator malfunctions, pressure medium is passed to one of the two pressure chambers and at the same time to one of the two pins. As a result, the camshaft adjuster, depending on the configuration of the control valve, after the actuating unit has failed is rotated into one of the two maximum positions and this phase position is held throughout the entire operation of the internal combustion engine. Since the central position, in which the camshaft adjuster is locked in the unpressurized state of the device, is selected in such a manner that the internal combustion engine has good starting and running properties in this phase position of the camshaft relative to the crankshaft, the starting and running properties of the internal combustion engine deteriorate as a result of a maximum phase shift relative to the central position.

SUMMARY OF THE INVENTION

Therefore, the invention is based on the object of avoiding these drawbacks which have been outlined and therefore providing a device for altering the control times of gas exchange valves of an internal combustion engine, which can be locked in a central position, the centre-position locking position being reached automatically after failure of the actuating unit of the control valve, at least after the internal combustion engine has been restarted, and the locking then being held in this position.

In a first embodiment, the object is achieved according to the invention by virtue of the fact that in a first control position of the control valve, which corresponds to the control position with the actuating unit unactivated, neither the first working port nor the second working port is in communication with the inlet port.

In a second embodiment, the object is achieved according to the invention by virtue of the fact that the control valve can adopt four control positions, in which case in a first control position of the control valve the volumetric flow from the inlet port to one of the two pressure chambers is equal to zero, in a second control position of the control valve the volumetric flow from the inlet port to one of the two pressure chambers is greater than zero, in a third control position of the control valve the volumetric flow from the inlet port to one of the two pressure chambers is approximately zero, and in a fourth control position of the control valve the volumetric flow from the inlet port to one of the two pressure chambers is greater than zero.

In a third embodiment, the object is achieved according to the invention by virtue of the fact that the control piston is provided with a third annular web, the external diameter of which is matched to the internal diameter of the valve housing, and the external diameter of the control piston between the annular webs being smaller than the internal diameter of the valve housing.

In an advantageous refinement of the invention, it is provided that the hydraulic actuating device has at least one locking pin and a slot guide in which the locking pin can engage in at least one position of the hydraulic actuating device so as to be able to fix the phase position of the camshaft with respect to the crankshall, and the hydraulic actuating device being locked in a central position when the phase position is fixed.

According to another conceivable option, the hydraulic actuating device has two locking pins and two slot guides, it being possible for each locking pin to engage in one of the slot guides in at least one position of the hydraulic actuating device, the phase position of the camshaft being fixed with respect to the crankshaft when both locking pins are engaging in the respective slot guide, and the hydraulic actuating device being locked in a central position when the phase position is fixed.

In an advantageous refinement of the first and third embodiments of the invention, it is provided that in the first control position, which corresponds to the control position with the actuating unit unactivated, neither working port or one working port or both working ports are connected to the outlet port T.

In an advantageous refinement of the first and second embodiments of the invention, it is provided that the valve body comprises a hollow valve housing and a control piston arranged displaceably therein, it being possible for the actuating unit to move the control piston within the valve housing into any desired position between two limit stops and to hold it in that position.

In an advantageous refinement of the first and third embodiments of the invention, it is provided that the control valve can be moved into four control positions by means of the actuating unit.

In this case, in a first control position of the control valve, which corresponds to the control position with the actuating unit unactivated, the first working port is in communication with the outlet port and the second working port is not in communication either with the outlet port or with the inlet port, while in a second control position of the control valve the first working port is in communication with the outlet port and the second working port is in communication with the inlet port, in a third control position of the control valve the first and second working ports are in communication neither with the outlet port nor with the inlet port, in a fourth control position of the control valve the second working port is in communication with the outlet port and the first working port is in communication with the inlet port.

Alternatively, in a first control position of the control valve, which corresponds to the control position with the actuating unit unactivated, the first working port is in communication with the outlet port and the second working port is in communication neither with the outlet port nor with the inlet port, while in a second control position of the control valve the first working port is in communication with the outlet port and the second working port is in communication with the inlet port, in a third control position of the control valve the first and second working ports are in communication with the inlet port, in a fourth control position of the control valve the second working port is in communication with the outlet port and the first working port is in communication with the inlet port.

The device is designed in such a manner that the control valve is in the first control position when a force between the minimum possible force $F_0$ and a small force $F_1$ is exerted by the actuating unit on the control piston, that the control valve is in the second control position when a force between a low force $F_1$ and a medium force $F_2$ is exerted by the actuating unit on the control piston, that the control valve is in the third control position when a force between a medium force $F_2$ and a high force $F_3$ is exerted by the actuating unit on the control piston, that the control valve is in the fourth control position when a force between a high force $F_3$ and a maximum force $F_4$ is exerted by the actuating unit on the control piston, where $F_0<F_1<F_2<F_3<F_4$.

The device is designed in such a manner that the control valve is in the first control position when the control piston has been displaced by a distance between 0 and $s_1$ relative to the position which it adopts when the actuating unit is exerting the minimum possible force on the control piston, that the control valve is in the second control position when the control piston has been displaced a distance between $s_1$ and $s_2$ relative to the position which it adopts when the actuating unit is exerting the minimum possible force on the control piston, that the control valve is in the third control position when the control piston has been displaced a distance between $s_2$ and $s_3$ relative to the position which it adopts when the actuating unit is exerting the minimum possible force on the control piston, that the control valve is in the first control position when the control piston has been displaced a distance between $s_3$ and $s_4$ relative to the position which it adopts when the actuating unit is exerting the minimum possible force on the control piston, where $0<s_1<s_2<s_3<s_4$.

Advantageously, in the third embodiment of the device, the third annular web is designed and arranged on the control piston in such a manner that it blocks the connection between the first working port and the inlet port when the control piston adopts a position which lies between a position which it adopts when the actuating unit is exerting the minimum possible force on it and a position $s_1$, whereas it does not block this connection in any other position of the control piston. In this case, the annular webs may be formed integrally with the control piston or may be separately produced sleeves which are non-positively, positively or cohesively connected or joined to the control piston, and the control piston is substantially hollow-cylindrical in form.

The device according to the invention is provided with a control valve which has been supplemented by a further, fourth control position compared to the 4/3-way directional control valve disclosed in the prior art. The second, third and fourth control positions correspond to the three control positions of the control valve of the prior art. The second control position corresponds to the unenergized state of the control valve described in the prior art, in which pressure medium flows via the inlet port to the first working port while pressure medium is flowing from the second port to the outlet port. The third control position corresponds to a second state of the control valve from the prior art, in which the two working ports are connected neither to the inlet port nor to the outlet port. The fourth control position corresponds to a third position of the control valve from the prior art, in which pressure medium is passed from the inlet port to the second working port and pressure medium is passed from the first working port to the outlet port. Unlike in the case of the control valve of the prior art, in the control valve of the device according to the invention, to alter the control times of gas exchange valves of an internal combustion engine, the first position of the control valve from the prior art is only reached after a defined displacement of the control piston relative to the valve housing. If the displacement is less or if there is no displacement at all, an additional (first) control position of the control valve is provided, in which neither the first working port nor the second working port is connected to the inlet port. If the actuating unit is defective, for example the supply of current to an electromagnet fails, the control piston is moved to the limit stop on the actuating unit side by means of a spring means. As a consequence, both working ports are disconnected from the inlet port, and therefore neither pressure chamber and neither locking pin is then supplied with pressure medium. After the internal combustion engine has been turned off, the pressure chambers and the feed lines are emptied towards the pressure chambers and the locking pins as a result of leakage. When the internal combustion engine is restarted, the absence of pressure medium and the drag or fluctuating torques of the camshaft mean that the rotor is moved into a position relative to the stator in which the locking pins can engage in the locking slot guide. On account of the fact that pressure medium is now no longer being supplied to the locking pins, the locking between rotor and stator remains in this position. This ensures that the phase position of the camshaft relative to the crankshaft is held in a position which is favourable for starting the internal combustion engine and good running properties are achieved while the internal combustion engine is operating.

Unlike with the control valve presented in the prior art, in this control valve of the device according to the invention for altering the control times of gas exchange valves of an internal combustion engine, the annular groove, which connects the radial working ports to the further port located between them in the axial direction, is provided with an additional annular web, which in the event of displacement of the control piston counter to the force of the spring means disconnects the first working port from the inlet port below a certain limit value. At the same time, the second annular web also disconnects the second working port from the pressure port. The result of this is that when the internal combustion engine is started or in the event of the actuating unit failing, no pressure medium is passed to the locking pins. As a result, the locking between rotor and stator remains in place and the phase position of the camshaft relative to the crankshaft which is required for favourable starting and running properties is retained.

A further advantageous effect in this embodiment is that there is no need for any design changes to be made to the cylinder head or the camshaft adjuster compared to embodiments which are known from the prior art. Furthermore, no additional costs are incurred in the production of the control valve. This embodiment therefore constitutes an inexpensive solution which does not require any changes to the design of the internal combustion engine.

BRIEF DESCRIPTION OF THE DRAWINGS

Further features of the invention will emerge from the following description and from the drawings, which represent simplified illustrations of exemplary embodiments of the invention and in which.

DETAILED DESCRIPTION OF THE DRAWING

Figure 1:
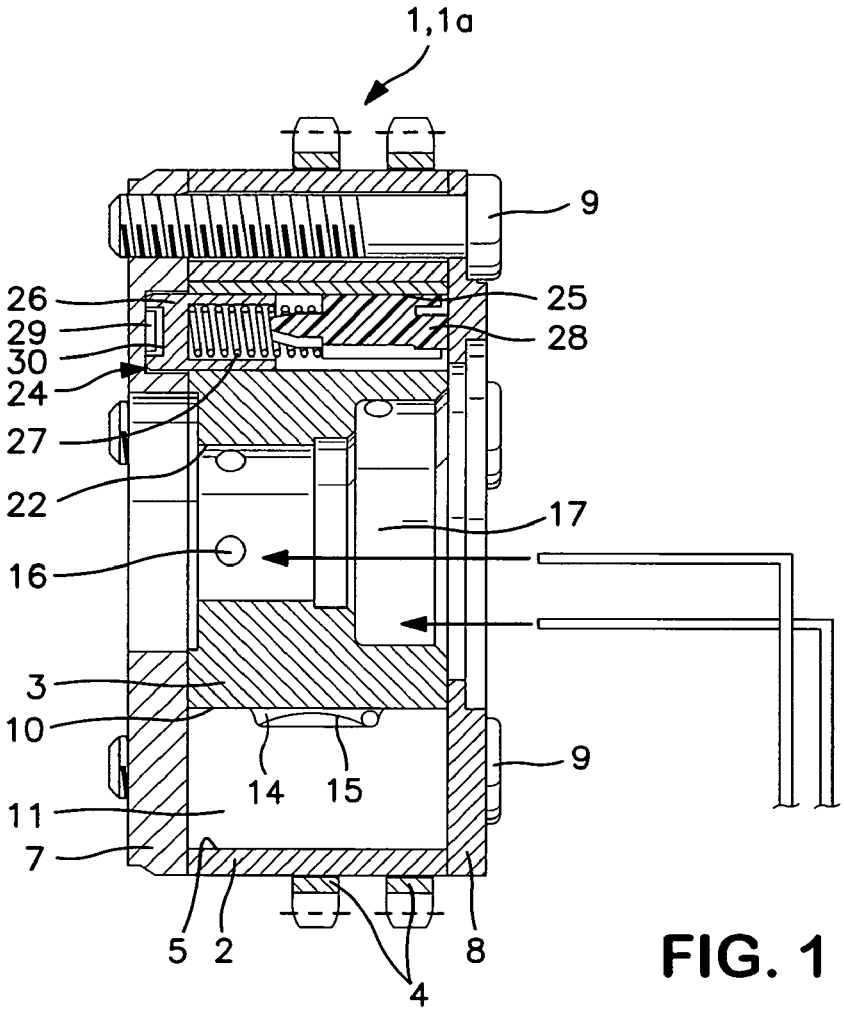
FIG. 1 shows a longitudinal section through a hydraulic actuating device.
Figure 2:
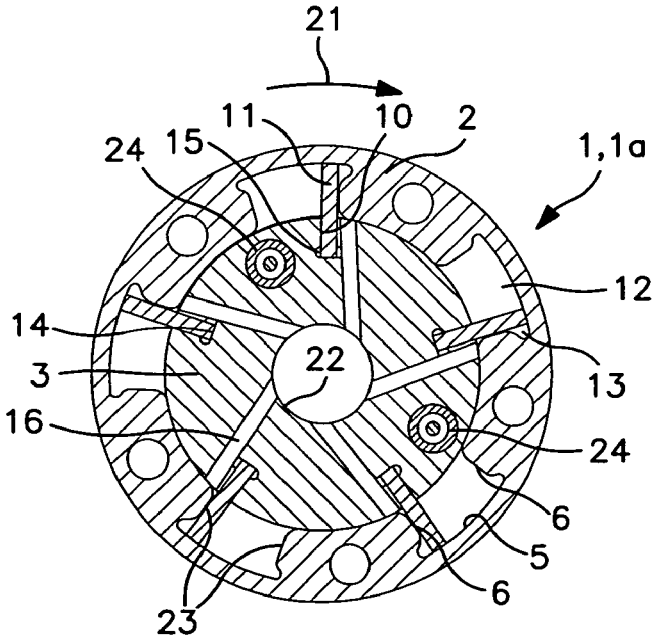
FIG. 2 shows a cross section through a hydraulic actuating device as shown in FIG. 1.

FIGS. 1 and 2 show a hydraulic adjusting device 1*a* of a device 1 for altering the control times of gas exchange valves of an internal combustion engine. The adjusting device 1*a* substantially comprises a stator 2 and a rotor 3 arranged concentrically with respect thereto. A drive wheel 4 is rotationally fixedly connected to the stator 2 and in the embodiment illustrated is designed as a sprocket. It is also conceivable to use embodiments of the drive wheel 4 in the form of a pulley or gearwheel. The stator 2 is mounted rotatably on the rotor 3, and in the embodiment illustrated five recesses 5 which are spaced apart from one another in the circumferential direction are provided on the inner lateral surface of the stator 2. The recesses 5 are delimited in the radial direction by the stator 2 and the rotor 3, in the circumferential direction by two side walls 6 of the stator 2 and in the axial direction by a first and a second side cover 7, 8. In this way, each of the recesses 5 is closed off in a pressure-tight manner. The first and second side covers 7, 8 are connected to the stator 2 by means of connecting elements 9, for example screws.

Axially running blade grooves 10 are formed on the outer lateral surface of the rotor 3, a radially extending blade 11 being arranged in each blade groove 10. A blade 11 extends into each recess 5, the blades 11 bearing against the stator 2 in the radial direction and against the side covers 7, 8 in the axial direction. Each blade 11 divides a recess 5 into two pressure chambers 12, 13 which work against one another. To ensure that the blades 11 bear in a pressure-tight manner against the stator 2, leaf spring elements 15, which apply a force to the blade 11 in the radial direction, are arranged between the groove bases 14 of the blade grooves 10 and the blades 11.

By means of first and second pressure-medium lines 16, 17, the first and second pressure chambers 12, 13 can be connected, via a control valve (not shown), to a pressure-medium pump, which is likewise not shown, or a tank, which is likewise not shown. This forms an actuating drive which allows the stator 2 to rotate relative to the rotor 3. In this context, it is provided that either all the first pressure chambers 12 are connected to the pressure-medium pump and all the second pressure chambers 13 are connected to the tank, or that precisely the opposite configuration is established. If the first pressure chambers 12 are connected to the pressure-medium pump and the second pressure chambers 13 are connected to the tank, the first pressure chambers 13 expand at the expense of the second pressure chambers 13. This results in a displacement of the blades 11 in the circumferential direction, in the direction indicated by the first arrow 21. The displacement of the blades 11 causes the rotor 3 to rotate relative to the stator 2.

In the embodiment illustrated, the stator 2 is driven by the crankshaft by means of a chain mechanism which acts on its drive wheel 4 and is not illustrated. It is also conceivable for the stator 2 to be driven by means of a belt or gearwheel drive mechanism. The rotor 3 is non-positively, positively or cohesively connected or joined to a camshaft (not shown), for example by means of a press fit or by means of a screw connection using a central screw. The rotation of the rotor 3 relative to the stator 2 caused by pressure medium being supplied to or discharged from the pressure chambers 12, 13 results in a phase shift between camshaft and crankshaft. Targeted introduction or removal of pressure medium into or from the pressure chambers 12, 13 can therefore be used to deliberately vary the control times of the gas exchange valves of the internal combustion engine.

In the embodiment illustrated, the pressure-medium lines 16, 17 are designed as substantially radially arranged bores which extend from a central bore 22 in the rotor 3 to its outer lateral surface. A central valve (not shown), via which the pressure chambers 12, 13 can be deliberately connected to the pressure-medium pump or the tank, may be arranged within the central bore 22. A further option is for a pressure-medium distributor, which connects the pressure-medium lines 16, 17 to the ports of an externally arranged control valve via pressure-medium conduits and annular grooves, to be arranged inside the central bore 22.

The substantially radially running side walls 6 of the recesses 5 are provided with moulded projections 23 which extend into the recesses 5 in the circumferential direction. The moulded projections 23 serve as a stop for the blades 11 and ensure that the pressure chambers 12, 13 can be supplied with pressure medium even when the rotor 3 is in one of its two limit positions relative to the stator 2, in which the blades 11 are bearing against one of the side walls 6.

If the supply of pressure medium to the device 1 is insufficient, for example during the starting phase of the internal combustion engine, the rotor 3 is moved in an uncontrolled manner relative to the stator 2 on account of the fluctuating and dragging torques which the camshaft exerts on it. In a first phase, the drag torques of the camshaft force the rotor in a circumferential direction relative to the stator, in the opposite direction to the direction of rotation of the stator, until they come into contact at the side walls 6. Subsequently, the fluctuating torques which the camshaft exerts on the rotor 3 lead to oscillation on the part of the rotor 3 and therefore the blades 11 in the recesses 5 until at least one of the pressure chambers 12, 13 has been completely filled with pressure medium. This leads to a higher level of wear and to the generation of noise in the device 1. To prevent this, two locking elements 24 are provided in the device 1. Each locking element 24 comprises a cup-shaped piston 26, which is arranged in an axial bore 25 in the rotor 3. The piston 26 is urged in the axial direction with a force by a spring 27. The spring 27 is axially supported against a venting element 28 on one side, while its other axial end is arranged inside the cup-shaped piston 26.

In the first side cover 7, there is one slot guide 29 per locking element 24, formed in such a manner that the rotor 3 can be locked relative to the stator 2 in a position which corresponds to the position when the internal combustion engine is starting. In this position, the pistons 26 are forced into the slot guides 29 by means of the springs 27 if the supply of pressure medium to the device 1 is insufficient. Furthermore, there are means for forcing the pistons 26 back into the axial bores 25, thereby cancelling out the locking, if there is a sufficient supply of pressure medium to the device 1. This is usually realized using pressure medium which is passed via pressure-medium lines (not shown) into a cut out 30 which is formed at the cover-side end of the pistons 26. If the phase position $\phi$ which corresponds to the starting position of the internal combustion engine corresponds to a central position of the blades 11 between the respective side walls 6, it is possible to lock the hydraulic actuating device 1*a* in this position by using two locking elements 24 and matching slot guides 29.

To enable leakage oil to be discharged from the spring space of the axial bore 25, the venting element 28 is provided with axially running grooves, along which the pressure medium can be passed to a bore in the second side cover 8.

Figure 8:
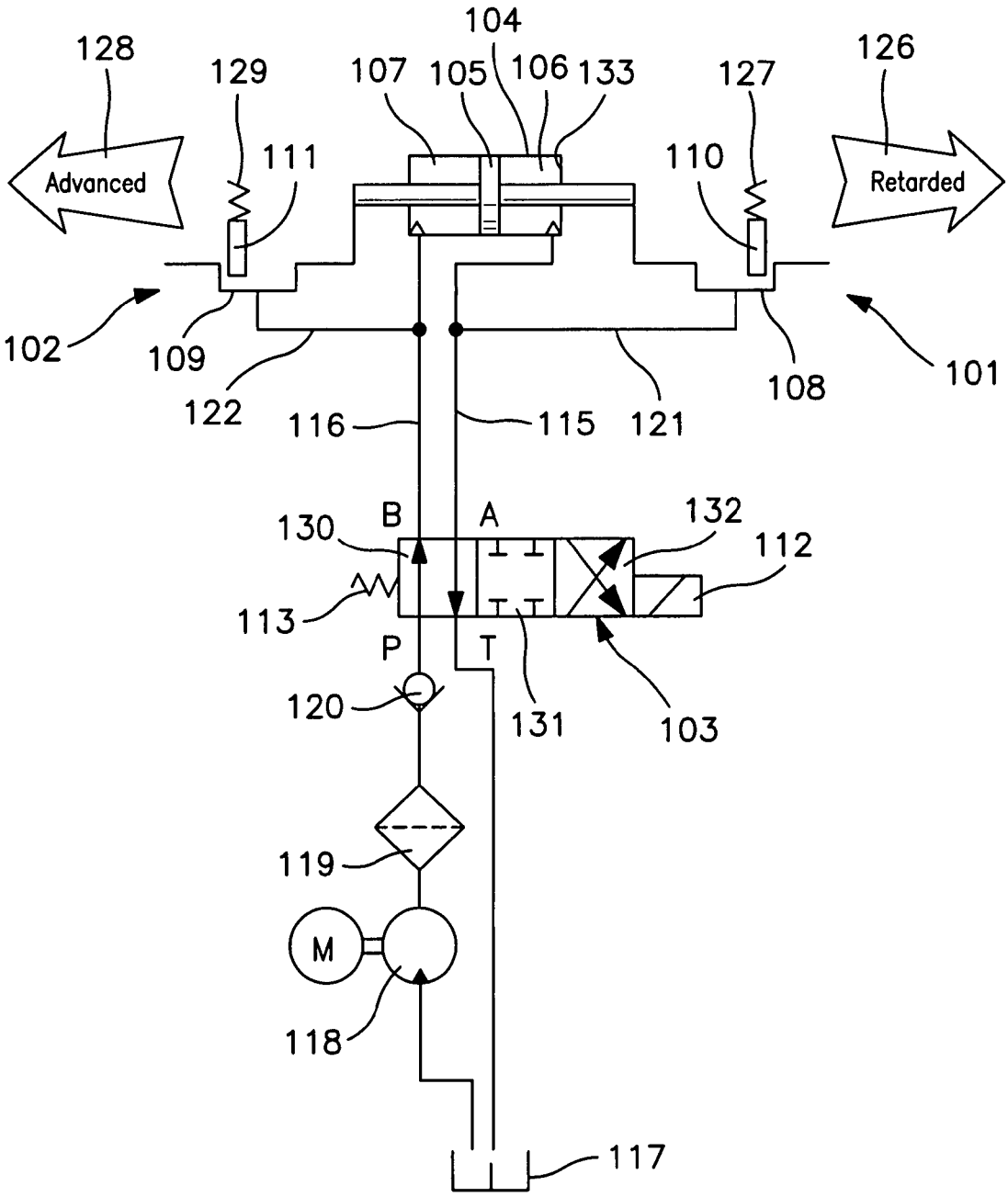
FIG. 8 PRIOR ART

FIG. 8 shows a device 101 for altering the control times of gas exchange valves of an internal combustion engine from the prior art. This device comprises a hydraulic actuating device 102 and a control valve 103. The actuating device 102 comprises a pressure space 104, which is divided into two pressure chambers 106, 107 acting against one another by a displaceable element 105. The displaceable element 105 is rotationally fixedly connected to the camshaft or the crankshaft, while the other component is rotationally fixedly connected to the pressure space 104. The displaceable element 105 is connected fixedly in terms of movement to two slot guides 108, 109. Furthermore, 110 and 111 each denote a locking pin, which is arranged in a fixed position with respect to the pressure space 104. Each slot guide 108, 109 is assigned a locking pin 110, 111. Alternatively, the locking pins 110, 111 can move with the element 105, and the slot guides 108, 109 may be formed in a component which is in a stationary position with respect to the pressure space 104.

The control valve 103 comprises an actuating unit 112, a first spring element 113 and a valve body 114. The actuating unit 112 may, for example, be designed in the form of an electrical or hydraulic actuating unit 112. In the text which follows, it will be assumed that this unit is an electrical actuating unit 112 designed as an electromagnet, without restricting the general concept of the invention. A first working port A, a second working port B, an inlet port P and an outlet port T are formed on the valve body 114. The first working port A is in communication with the first pressure chamber 106 via a first pressure-medium line 115, and the second working port B is in communication with the second pressure chamber 107 via a second pressure-medium line 116. Furthermore, the outlet port T is in communication with a pressure-medium reservoir 117. The inlet port P is supplied with pressure medium via a pressure-medium pump 118, a filter 119 and a non-return valve 120. The first slot guide 108 is in communication with the first pressure-medium line 115 via a third pressure-medium line 121. Likewise, the second slot guide 109 is in communication with the second pressure-medium line 116 via a fourth pressure-medium line 122. The first and second slot guides 108, 109 are each designed as a groove, the dimension of which in the direction of movement of the moveable element 105 is larger than that of the respective locking pin 110, 111. In the central position of the displaceable element 105 illustrated, both locking pins 110, 111 engage in the respective slot guide 108, 109 and are arranged at one end of the respective groove as seen in the direction of displacement of the moveable element 105.

The valve can be moved, by means of the actuating unit 112, counter to the spring force of the first spring element 113, into a second, third and fourth control position 130, 131, 132. If the valve is in the second control position 130, which is the case if the actuating unit 112 is not energized or is only slightly energized, the second working port B is connected exclusively to the inlet port P and the first working port A is connected exclusively to the outlet port T. If the valve is in the third control position 131, which is the case when the actuating unit 112 is slightly energized or energized at a medium level, both working ports A, B are connected neither to the inlet port P nor to the outlet port T. Alternatively, it is possible to provide for both working ports A, B to be connected exclusively to the inlet port P, in order to compensate for leakage losses.

If the valve is in the fourth control position 132, as is the case when the actuating unit 112 is energized to a medium to maximum extent, the first working port A is connected exclusively to the inlet port P and the second working port B is connected exclusively to the outlet port T.

In controlled operation of the internal combustion engine, the control valve 103 is moved into the second control position 130, in order to adjust the moveable element 105 in the late direction, indicated by the second arrow 126. Pressure medium is passed from the inlet port P via the second working port B and the second pressure-medium line 116 to the second pressure chamber 107. At the same time, pressure medium is passed into the second slot guide 109 via the fourth pressure-medium line 122. As a result, the second locking pin 111 is forced out of the second slot guide 109 counter to the force of a second spring 129. At the same time, the first pressure chamber 106 is connected to the pressure-medium reservoir 117 via the first pressure-medium line 115 and the outlet port T. The removal of pressure medium from the first pressure chamber 106 and the supply of pressure medium to the second pressure chamber 107 shifts the moveable element 105 in the late direction. At the same time, the first and second slot guides 108, 109 are likewise shifted in the late direction. In the process, the first locking pin 110 moves inside the first slot guide 108, while the second locking pin 111 is located outside the second slot guide 109.

To hold a phase position $\phi$ of the hydraulic actuating device 102, the control valve 103 is moved into the third control position 131. Both working ports A, B are connected neither to the inlet port P nor to the outlet port T. There is no flow of pressure medium to or from the pressure chambers 106, 107, and the phase position $\phi$ is kept constant.

To adjust the moveable element 105 in the early direction, indicated by the third arrow 128, the control valve 103 is moved into the fourth control position 132. Pressure medium is passed from the inlet port P via the first working port A and the first pressure-medium line 115 to the first pressure chamber 106. At the same time, pressure medium is passed into the first slot guide 108 via the third pressure-medium line 121. As a result, the first locking pin 110 is forced out of the first slot guide 108 counter to the force of a first spring 127. At the same time, the second pressure chamber 107 is connected to the pressure-medium reservoir 117 via the second pressure-medium line 116 and the outlet port T. The removal of pressure medium from the second pressure chamber 107 and the supply of pressure medium to the first pressure chamber 106 shifts the moveable element 105 in the early direction. At the same time, the first and second slot guides 108, 109 are likewise shifted in the early direction. In the process, the second locking pin 111 moves within the second slot guide 109, while the first locking pin 110 is located outside the first slot guide 108.

If the moveable element 105 is adjusted from a position which deviates from the central position illustrated in FIG. 8 across the central position, the locking pin 110, 111 which is not being acted on by pressure medium latches into the respective slot guide 108, 109. At the same time, pressure medium is applied to the other locking pin 110, 111, in such a way that it is located outside the slot guide 108, 109. The movement is restricted exclusively by the latched-in locking pin 110, 111.

If the hydraulic actuating device 102 is in the central position illustrated in FIG. 8 and if the device 101 is not being supplied with sufficient pressure medium, as is the case for example when the internal combustion engine is starting up, both locking pins 110, 111 are latched in the respective slot guide 108, 109. In this case, the locking pins 110, 111 are arranged in such a manner and the slot guides 108, 109 are designed in such a manner that the locking pins 110, 111 are located at those ends of the slot guides 108, 109 which are located furthest away from one another. As a result, the moveable element 105 is fixed relative to the pressure space 104. Alternatively, the locking pins 110, 111 may be located at those ends of the slot guides 108, 109 which are closest together. In this alternative embodiment, the first slot guide 108 would have to be supplied with pressure medium from the second pressure-medium line 116, and the second slot guide 109 would have to be supplied with pressure medium from the first pressure-medium line 115. It is also conceivable for the slot guides 108, 109 to be supplied via the respective pressure chamber 106, 107, for example by means of a worm groove.

When the internal combustion engine is stopping, it is possible that the displaceable element 105 will be positioned in a position which is late relative to the central position when the engine is restarted, the device 101 is not yet sufficiently filled with pressure medium. On account of the drag torque of the camshaft, the element 105 is driven in the direction of the late stop 133 and comes into contact with it. This leads to increased wear to the components and to the production of undesirable noise.

If the actuating unit 112 of the control valve 103 fails, for example if the power supply is interrupted as a result of a defect in the electromagnet or the current connections, the control valve 103 is moved into the second control position 130. The result of this is that the second locking pin 111 is unlocked and the camshaft is adjusted in the late direction relative to the crankshaft. Consequently, the starting and running properties of the internal combustion engine, which are optimal in the central position illustrated in FIG. 8, deteriorate.

The diagrammatically depicted hydraulic actuating device 102 may, for example, be an axial piston adjuster or a rotary piston adjuster. In the text which follows, only the embodiment of a rotary piston adjuster will be dealt with, without this restricting the general concept of the invention. The pressure space 104 corresponds to the recesses 5 shown in FIG. 1. The moveable element 105 corresponds to the blades 11. In the embodiment shown in FIG. 1, the locking pins 110, 111 can be arranged either in a side cover of the rotary piston adjuster or in the rotor of the rotary piston adjuster within a bore, preferably a blind bore. The respective slot guides 108, 109 are formed in the respective other component.

Figure 4:
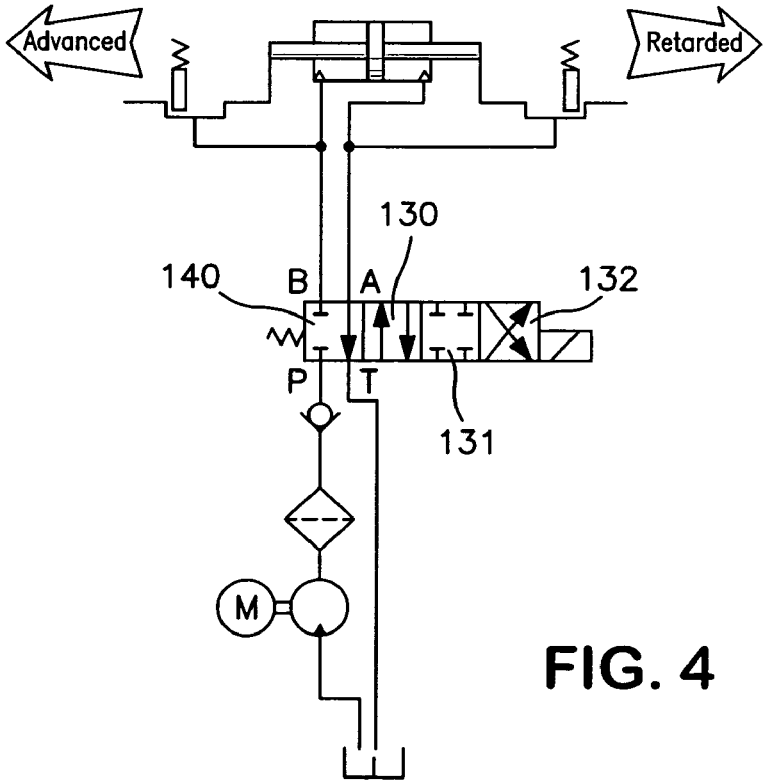

FIG. 4 diagrammatically depicts a device 101 according to the invention, similar to that shown in FIG. 8. This is largely identical to that shown in FIG. 8, and consequently the same reference numerals have been used for the same components. The difference of the device 101 according to the invention is that the control valve 103 additionally has a first control position 140. The first control position 140 is activated when the actuating unit 112 adopts a position corresponding to low or no energizing. In this case, the first spring element 113 ensures that the first control position 140 is reached. In this position, neither the first working port A nor the second working port B is connected to the inlet port P. Depending on the configuration of the hydraulic actuating device 102, it is now possible for either the first or the second working port A, B to be connected to the outlet port T, while the respective other working port A, B is not in communication with the outlet port T. It is also conceivable to use an embodiment in which in the first control position 140 the first and second working ports A, B are in communication neither with the inlet port P nor with the outlet port T, or both working ports A, B are in communication exclusively with the outlet port T.

In addition to the first control position 140, the control valve 103 also has the second, third and fourth control positions 103, 131, 132 illustrated in FIG. 8, with the second control position 130 being adopted if the actuating unit 112 has a low to medium level of energization, the third control position 131 being adopted if the actuating unit 112 has a medium to high level of energization and the fourth control position 132 being adopted if the actuating unit 112 has a high to maximum level of energization.

If the actuating unit 112 is defective or if there is a problem in the supply of current to it, the control valve 103 automatically moves into the first control position 140, the switching valve 103 holding this position until the actuating unit 112 or its power supply is repaired. After the internal combustion engine has been restarted, the inadequate supply of pressure medium to the hydraulic actuating device 102 means that the moveable element 105 is moved into the central position irrespective of its position when the internal combustion engine was turned off, on account of the dragging and fluctuating torques. In this central position, the two locking pins 110, 111 can lock into the respective slot guide 108, 109, thereby fixing the position of the moveable element 105 in the pressure space 104. On account of the configuration of the first control position 140, while the internal combustion engine is operating no pressure medium is fed to the pressure chambers 106, 107 and therefore to the slot guides 108, 109. The result of this is that the moveable element 105 is held in a fixed position relative to the pressure space 104, and therefore the phase position $\phi$ between camshaft and crankshaft is kept constant in the emergency running position, in which the internal combustion engine has good starting and running properties.

FIGS. 5*a* to 5*d* show, by way of example, a valve body 114 of a control valve 103 of a device 101 according to the invention. The valve body 114 comprises a valve housing 141 and a control piston 142. The valve housing 141 is substantially hollow-cylindrical in form, with three annular grooves 143, 144, 145 formed spaced apart in the axial direction in its outer lateral surface. Each of the annular grooves 143 to 145 produces a port of the valve, the axially outer annular grooves 143, 145 forming the working ports A, B, and the middle annular groove 144 forming the inlet port P. An outlet port T is produced by an opening in an end side of the valve housing 141. Each of the annular grooves 143 to 145 is in communication with the interior of the valve housing 141 via first radial openings 146. A substantially hollow-cylindrical control piston 142 is arranged axially displaceably inside the valve housing 141. The control piston 142 is acted on by a force at one end side by a second spring element 147 and at the opposite end face by a tappet push rod 148 of the actuating unit 112. Energizing the actuating unit 112 allows the control piston 142 to be displaced counter to the force of the second spring element 147 into any desired position between a first limit stop 149 and a second limit stop 150.

The control piston 142 is provided with a first annular web 151 and a second annular web 152. The external diameters of the annular webs 151, 152 are matched to the internal diameter of the valve housing 141. Furthermore, second radial openings 146*a*, via which the interior of the control piston 142 is in communication with the interior of the valve housing 141, are formed in the control piston 142 between its end on which the tappet push rod 148 acts and the second annular web 152. The first and second annular webs 151, 152 are designed and arranged on the outer lateral surface of the control piston 142 in such a manner that control edges 153 to 156 open or close a connection between the inlet port P and the working ports A, B and open or close a connection between the working ports A, B and the outlet port T depending on the position of the control piston 142 relative to the valve housing 141. The external diameter of the control piston 142 is designed to be narrower in the regions between the tappet push rod 148 and the second annular web 152 and between the first annular web 151 and the second annular web 152 than the internal diameter of the valve housing 141. As a result, a fourth annular groove 157 is formed between the first and second annular webs 151, 152. A third annular web 158 is formed within the fourth annular groove 157. The external diameter of the third annular web 158 is matched to the internal diameter of the valve housing 141. Furthermore, the third annular web 158 is positioned in such a manner that in the first control position 140 of the control valve 103 it closes the connection between the inlet port P and the second working port B.

Figure 5A:
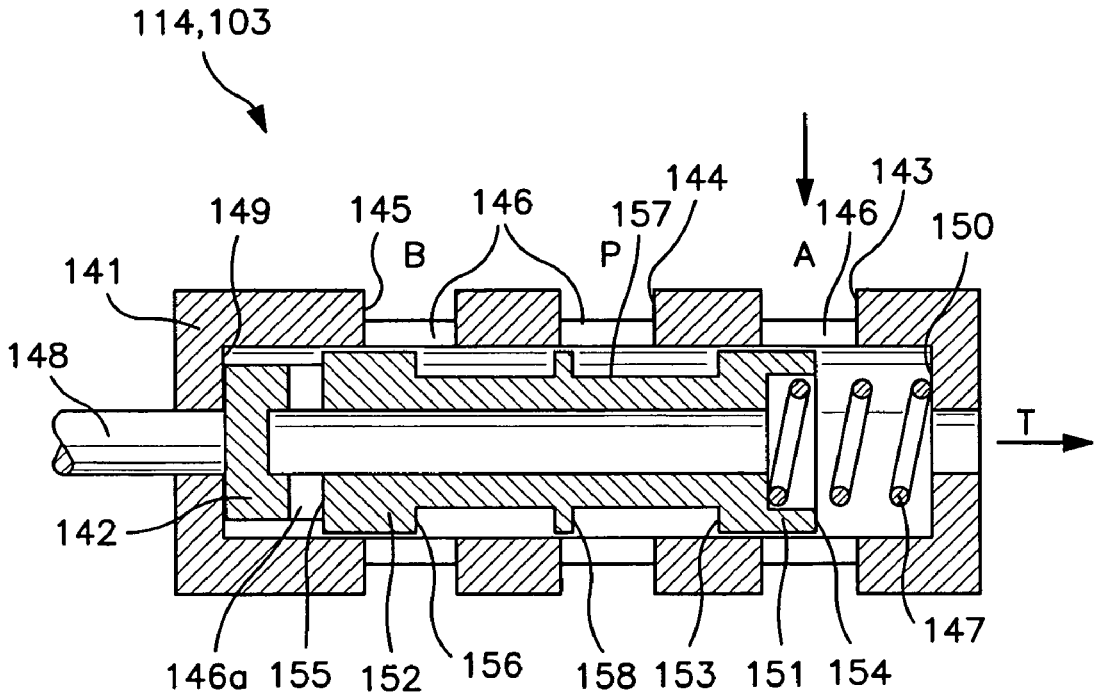
FIG. 5*a* shows a longitudinal section through a control valve of a device according to the invention for altering the control times of gas exchange valves of an internal combustion engine in a first control position.

FIG. 5*a* shows the first control position 140 of the control valve 103, in which the control piston 142 is acted on by the actuating unit 112, via the tappet push rod 148, with a force which is between a minimum force $F_0$ and a low force $F_1$, where $F_1>F_0$. The end face of the control piston 142 on the tappet push rod side is located in a region between the first limit stop 149 (displacement=0 mm) and a displacement $s_1$. The connection between the inlet port P and the second working port B is closed off by the third annular web 158, and the connection between the inlet port P and the first working port A is closed off by the first annular web 151. Furthermore, the connection between the second working port B and the outlet port T is closed off by means of the second annular web 152, while pressure medium can flow from the first working port A to the outlet port T. Since the flow of pressure medium to both locking pins 110, 111 and to both pressure chambers 106, 107 is blocked, there can be no active adjustment in the first control position 140. The connection of the first pressure chamber 106 to the reservoir 11 causes this pressure chamber to be emptied. Depending on the position of the hydraulic actuating device 102, the moveable element 105 is driven into the central position immediately or after a certain time which is required in order to empty the second pressure chamber 107 on account of leakage, as a result of drag or fluctuating torques of the camshaft, and is permanently locked in this central position.

This control position corresponds to a configuration of the control valve 103 in which the actuating unit 112 is unenergized, and consequently the control piston 142 has been displaced onto the first limit stop 149 by means of the second spring element 147, and therefore the displacement is zero. The valve is in this position if the actuating unit 112 is defective or its power supply has been interrupted.

Figure 5B:
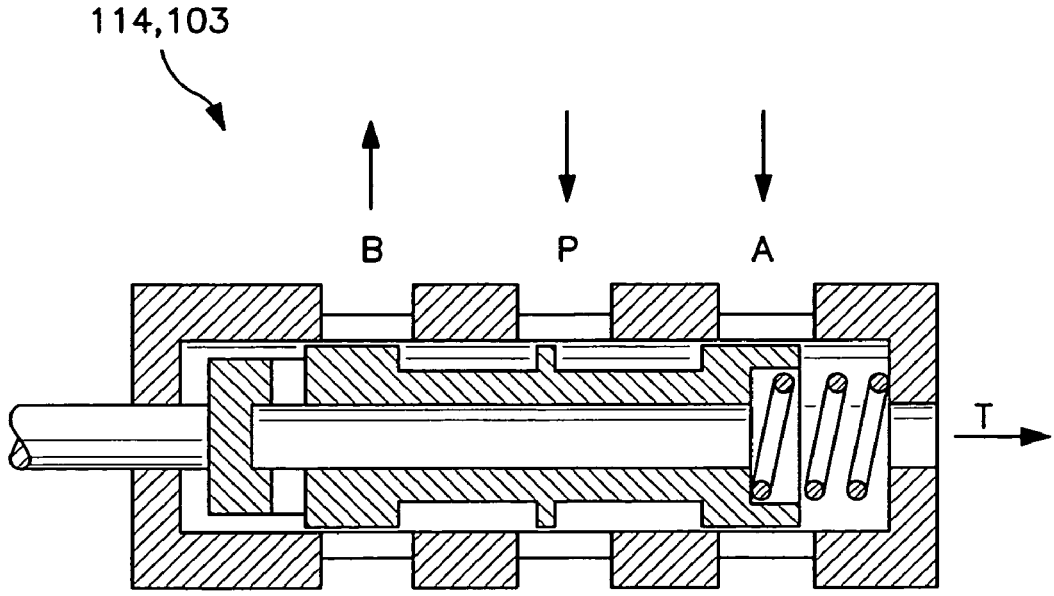
FIG. 5*b* shows a longitudinal section through the control valve shown in FIG. 5*a* in a second control position.

FIG. 5*b* shows the second control position 130 of the control valve 103, in which the control piston 142 is acted on by the actuating unit 112 via the tappet push rod 148 with a force between a low force $F_1$ and a medium force $F_2$, where $F_2>F_1$. As a result, the control piston 142 has been displaced a distance $S_1$ to $S_2$ from the first limit stop 149 on the tappet push rod side, where $S_2>S_1$. The first annular web 151 is still blocking the connection between the first working port A and the inlet port P, while pressure medium can continue to flow from the first working port to the outlet port T. Furthermore, the second annular web 152 is blocking the connection between the second working port B and the outlet port T, while both the second and third annular webs 152, 158 open a connection between the inlet port P and the second working port B. In this position, pressure medium is being fed to the second pressure chamber 107 and the second slot guide 109 via the second working port B and the second and fourth pressure-medium lines 116, 122, with the result that the second locking pin 111 is unlocked and the hydraulic actuating device 102 is adjusted in the late direction. At the same time, pressure medium flows out of the first pressure chamber 106 via the first pressure-medium line 115 to the first working port A and from there to the outlet port T.

Figure 5C:
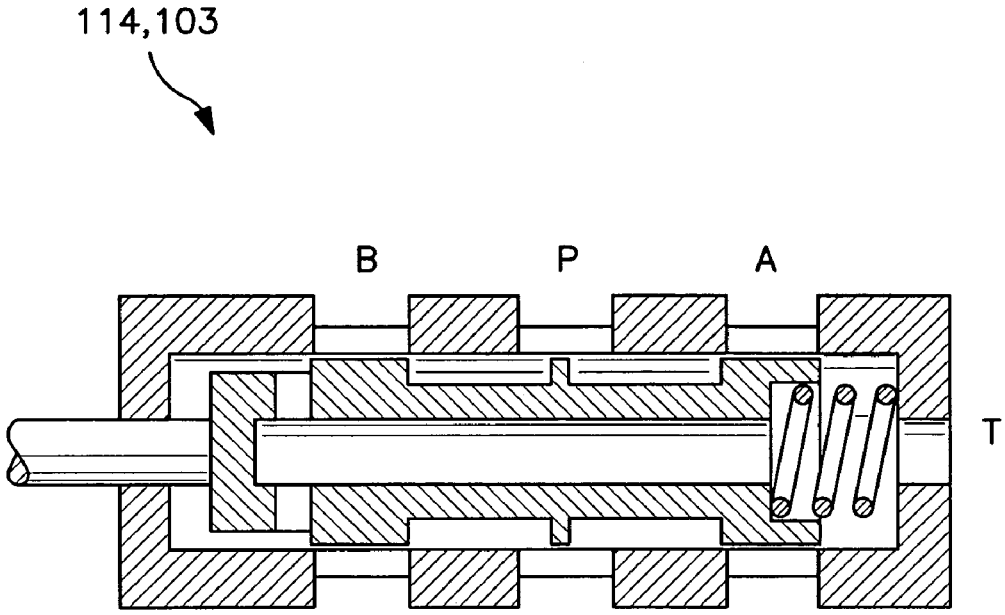
FIG. 5*c* shows a longitudinal section through the control valve shown in FIG. 5*a* in a third control position.

FIG. 5*c* shows the third control position 131 of the control valve 103, in which the control piston 142 is being acted on by the actuating unit 112 via the tappet push rod 148 with a force between a medium force $F_2$ and a high force $F_3$, where $F_3>F_2$. As a result, the control piston 142 is displaced a distance $S_2$ to $S_3$ from the first limit stop 149 on the tappet push rod side, where $S_3>S_2$. In this position of the switching valve, the first and second annular webs 151, 152 are blocking the connections between the working ports A, B and the inlet port P and the connections between the working ports A, B and the outlet port T. In this position of the control valve 103, pressure medium is not being fed to the pressure chambers 106, 107 and nor can pressure medium flow out of the pressure chambers 106, 107. This control position therefore corresponds to a holding position, in which the phase position $\phi$ between camshaft and crankshaft is kept constant.

Figure 5D:
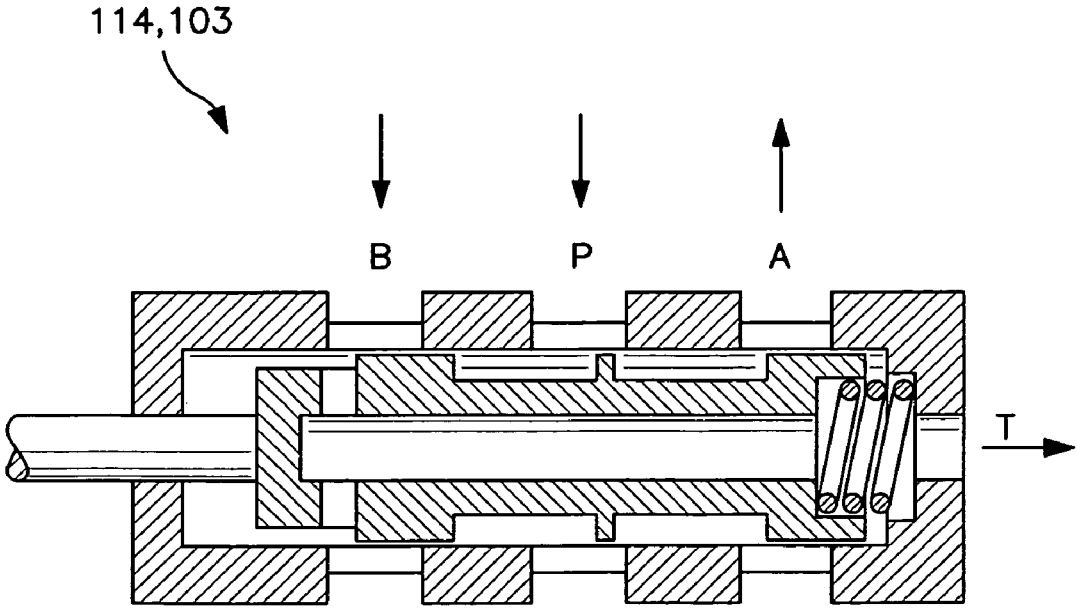
FIG. 5*d* shows a longitudinal section through the control valve shown in FIG. 5*a* in a fourth control position.

FIG. 5*d* shows the fourth control position 132 of the control valve 103, in which the control piston 142 is being acted on by the actuating unit 112 via the tappet push rod 148 with a force between a high force $F_3$ and a maximum force $F_4$, where $F_4>F_3$. As a result, the control piston 142 is displaced a distance $S_3$ to $S_4$ from the first limit stop 149 on the tappet push rod side, where $S_4>S_3$. In this configuration, the first annular web 151 is blocking a connection between the first working port A and the outlet port T, while the connection between the inlet port P and the first working port A is opened up both by the first annular web 151 and by the third annular web 158. Furthermore, the second annular web 152 is blocking the connection between the inlet port P and the second working port B, while pressure medium can pass via the second working port B and the second radial openings 146*a* into the interior of the control piston 142 and from there to the outlet port T. In this position of the control valve 103, pressure medium is passed from the second pressure chamber 107 via the second pressure-medium line 116 to the second working port B and from there to the outlet port T. At the same time, pressure medium is being passed to the first pressure chamber 106 and to the first slot guide 108 via the first working port A, the first pressure-medium line 115 and the third pressure-medium line 121. As a result, the first locking pin 110 is unlocked and the hydraulic actuating device 102 is adjusted in the early direction.

The use of the 4/4-way valve described as control valve 103 for the device 101 according to the invention means that there is no need for any additional modules, such as for example additional control valves, to produce a device 101 with centre-position locking which automatically starts in a locked central position without the element 105 (blade in the case of blade cell adjusters) striking a stop. Neither the space required nor the production or assembly costs are increased compared to the embodiment described in the prior art. At the same time, if the actuating unit 112 fails, the device 101 is moved into the central position and locked there until the actuating unit 112 is repaired.

Figure 6:
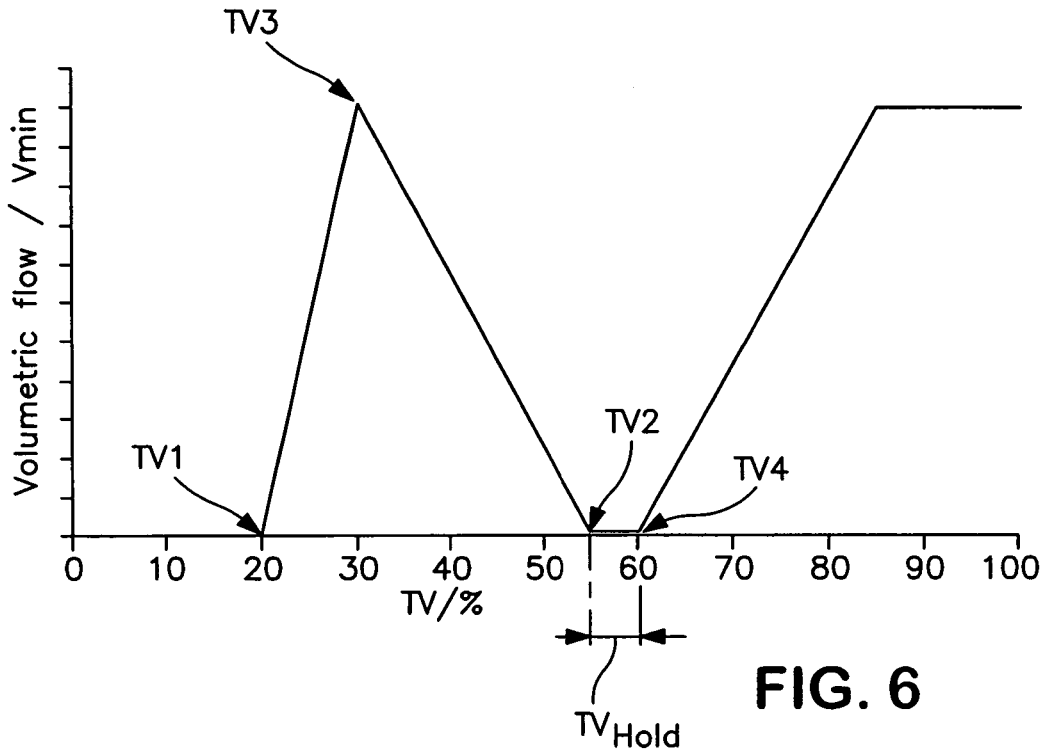
FIG. 6 shows the volumetric flow from the inlet port to the pressure chambers depending on the position of the control piston relative to the valve housing.

FIG. 6 shows the volumetric flow from the inlet port T to the pressure chambers 106, 107 depending on the duty factor of the actuating unit 112. The actuating unit 112 can be acted on by a voltage, with either zero volts or a maximum value applied. The duty factor indicates the proportion of time during which the maximum value of the voltage is applied to the actuating unit 112. The higher the duty factor, the higher the force which is exerted on the control piston 142 by the actuating unit 112 via the tappet push rod 148. Therefore, the duty factor is a measure of the displacement of the control piston 142 within the valve housing 141 relative to the first limit stop 149.

In a first range, in which the duty factor is between zero and a first value DF1, the control valve 103 adopts the first control position 140. In this control position 140, the connections between the inlet port P and the working ports A, B are blocked, and the volumetric flow, apart from leakage flows, is 0.

If the duty factor is between a first value DF1 and a second value DF2, the control value 103 is in the second control position 130. Pressure medium can pass from the inlet port P to the second working port B, while the connection between the inlet port P and the first working port A is blocked. The volumetric flow rises continuously if the duty factor increases from a first value DF1 to a third value DF3, while if the duty factor rises further to the second value DF2 the volumetric flow decreases continuously, ultimately reaching close to zero at the value DF2. Only the range between DF3 and DF2 is advantageously used for the second control position 130.

In a third range between the value DF2 and a value DF4 (duty factors which lie in this range are referred to below as the holding duty factor) of the duty factor, the volumetric flow is virtually zero. This range corresponds to the third control position 131 of the control valve 103, in which neither working port A, B is in communication with the inlet port P.

If the value of the duty factor is increased further from the value DF4 up to 100%, the volumetric flow from the inlet port P to the pressure chamber 106, 107 initially increases continuously. The volumetric flow may increase continuously up to a duty factor of 100% or may pass through a maximum for design reasons. This range corresponds to the fourth control position 132 of the control valve 103, in which pressure medium is passed from the inlet port P to the first working port A while the connection between the inlet port P and the second working port B is blocked.

In addition to the advantage whereby if the actuating unit 112 fails during a restart of the internal combustion engine the hydraulic actuating device 102 is locked in a central position and this locking is retained, the device 101 according to the invention, with the actuating unit 112 intact, allows the hydraulic actuating device 102 to be locked in the central position when the internal combustion engine is being turned off or allows the hydraulic actuating device 102 to be positioned in such a manner that when the internal combustion engine is restarted the hydraulic actuating device 102 is moved into and locked in the central position. This has the advantage that during the starting operation, in which the device 101 is not yet sufficiently full of pressure medium, the hydraulic actuating device 102 is reliably locked in the central position, which prevents the displaceable element 105 from coming into contact with a side wall of the pressure space 104, thereby preventing increased wear and noise.

To operate the internal combustion engine, the various duty factors, in particular DF1 to DF3 and the holding duty factor $DF_{hold}$, have to be known to the engine control unit. The holding duty factor is determined as standard by the engine control unit and stored in a memory unit. There are two conceivable options for determining DF1, DF2 and DF3.

DF1, DF2 and DF3 can be determined as a direct function of the holding duty factor $DF_{hold}$ on the basis of the structural design and the ensuing valve characteristics. The differential angles $Y_1$, $Y_2$ and $Y_3$ are stored permanently in a memory unit. In an early operating phase of the internal combustion engine, the engine control unit determines the holding duty factor $DF_{hold}$. The following then apply for DF1, DF2 and DF3:

$$DF1=DF_{hold}-Y1,$$

$$DF2=DF_{hold}-Y2,$$

$$DF3=DF_{hold}-Y3.$$

A second way is for DF1 and DF2 to be determined by the engine control unit, if appropriate after each restart of the engine, and for these values to be stored in the engine map. The camshaft angle signals and crankshaft angle signals can be used to determine DF1 and DF3. In particular the relative phase position of the two shafts and the time change in the phase position can be used for this purpose. By way of example, the following method can be employed. A duty factor ramp rising from 0% is deployed. The value DF1 has been reached when an adjustment operation starts (at this point, pressure medium is supplied to one of the pressure chambers 106, 107 and one locking pin 110, 111, and the hydraulic actuating device is adjusted, which can be detected using camshaft angle sensors and crankshaft angle sensors). The value DF3 has been reached when a maximum adjusting rate is exceeded. DF2 has been reached when the phase position is kept constant. The values determined are then stored in a memory.

Figure 7:
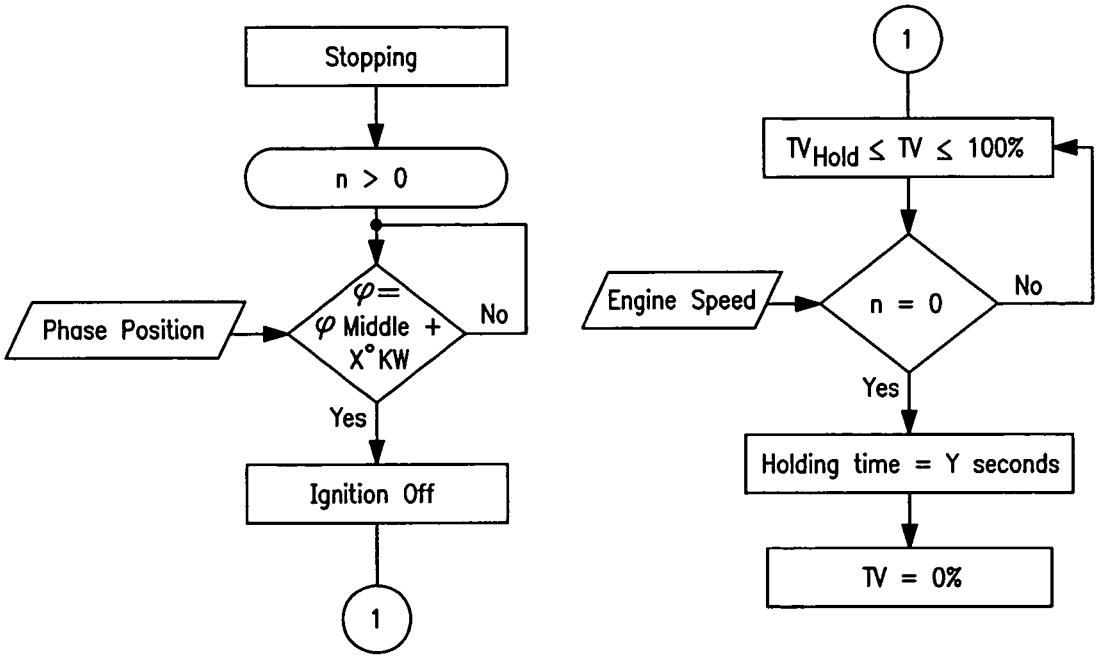
FIG. 7 shows a method for turning off an internal combustion engine in a controlled way using a device according to the invention for altering the control times of gas exchange valves, and FIG. 8 diagrammatically depicts a device for altering the control times of gas exchange valves of an internal combustion engine from the prior art.

FIG. 7 shows a flow diagram of a method for controlling the device 101 according to the invention while the internal combustion engine is stopping, by which method the hydraulic actuating device 102 is moved into a position in which, after the internal combustion engine has stopped, it is either locked or in a position from which it is immediately moved into and locked in the central position as soon as the internal combustion engine is restarted.

When initiating the stopping of the internal combustion engine, the engine speed is n>zero. The phase position $\phi$ between the camshaft and the crankshaft is moved into a shut-down phase position, which deviates by a defined amount X from the locking phase position ($\phi_{central}$, with the aid of the control valve 103. For a device 101 which is designed without a compensation spring, the shut-down phase position is shifted in the early direction relative to the locking phase position ($\phi_{central}$. The same applies to a device 101 which is equipped with a compensation spring, the torque of which, however, is lower than the drag torque of the camshaft. For a device 101 with a compensation spring which exerts a torque which is greater than the drag torque of the camshaft, the shut-down phase is shifted in the late direction relative to the locking phase position $\phi_{central}$. When the predetermined shut-down phase position has been reached, the ignition is switched off and the value of the duty factor is set in such a manner that this phase position $\phi$ is reliably maintained. If a shut-down phase position which is shifted in the early direction has been set, therefore, the duty factor is between DF2 and 100%, whereas if a shut-down phase position is adjusted in the late direction relative to the locking phase position $\phi_{central}$, the duty factor is between DF4 and DF3. This duty factor is maintained until the engine speed sensors report an engine speed of zero. Then, the duty factor which has been set is held for a certain period of time Y before ultimately the actuating unit 112 is kept de-energized. The holding time of Y prevents the locking pins 110, 111 from being unlocked and the moveable element 105 being moved across the central position into the incorrect position during the final revolution of the internal combustion engine, during which the engine speed sensor is already delivering engine speed n=0, on account of pressure fluctuations caused by the fluctuating torques.

The hydraulic actuating device 102 is now either in the locked position, on account of the final revolution of the crankshaft, or in a position in which it is automatically and immediately driven into the locked position when the internal combustion engine is started up, either by the drag torques of the camshaft or by the torque of the compensation spring.

Figure 3:
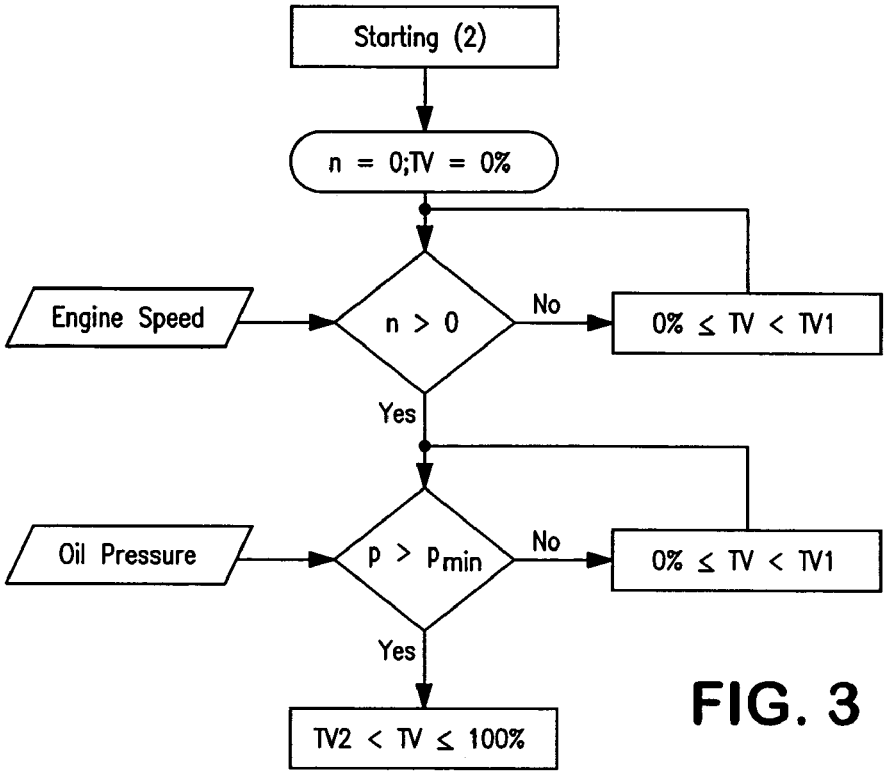
FIG. 3 shows a method for starting an internal combustion engine using a device according to the invention for altering the control times of gas exchange valves, FIG. 4 diagrammatically depicts a device according to the invention for altering the control times of gas exchange valves of an internal combustion engine.

FIG. 3 shows a flow diagram of a method for starting an internal combustion engine using a device 101 according to the invention, which ensures that locking of the moveable element 105 which is already present or is produced during the first revolution of the crankshaft is maintained until the oil pressure within the internal combustion engine has risen to a level which is required for reliable operation of the device 101. At the beginning of the starting operation, the engine speed n and the duty factor are equal to zero. As long as the engine speed sensor reports an engine speed n=zero, the duty factor is held between zero % and the value DF1. When the engine speed sensor reports an engine speed greater than 0, the value of an oil pressure sensor is read. As long as the value of the oil pressure p is lower than a defined minimum value $p_{min}$ which is required for reliable operation of the device 101 according to the invention, the value of the duty factor is kept between zero % and the value DF1. When the oil pressure p exceeds the predetermined pressure, the device 101 moves into the controlled operating mode and the duty factor is adjusted between DF3 and 100%, depending on the load state of the engine.

The above embodiments are only examples. Of course, the working ports A, B can be swapped over. Devices 101 with centre-position locking of the hydraulic actuating unit 102 in which only one locking pin can engage in a slot guide or a stepped slot guide are also intended to be encompassed by the scope of protection. The same also applies to devices with any desired locking phase position with one or more locking pins. Pressure losses caused by leakage were discounted in the considerations relating to the volumetric flows and the connections between various ports of the switching valve.

LIST OF DESIGNATIONS

1 Device
1*a* Hydraulic actuating device
2 Stator
3 Rotor
4 Drive wheel
5 Recesses
6 Side wall
7 First side cover
8 Second side cover
9 Connecting element
10 Blade groove
11 Blade
12 First pressure chamber
13 Second pressure chamber
14 Groove base
15 Leaf spring element
16 First pressure-medium line
17 Second pressure-medium line
21 First arrow
22 Central bore
23 Moulded projections
24 Locking element
25 Axial bore
26 Piston
27 Spring
28 Venting element
29 Stop guide
30 Cut out
101 Device
102 Hydraulic actuating device
103 Control valve
104 Pressure space
105 Element
106 First pressure chamber
107 Second pressure chamber
108 First slot guide
109 Second slot guide
110 First locking pin
111 Second locking pin
112 Actuating unit
113 First spring element
114 Valve body
115 First pressure-medium line
116 Second pressure-medium line
117 Pressure-medium reservoir
118 Pressure-medium pump
119 Filter
120 Non-return valve
121 Third pressure-medium line
122 Fourth pressure-medium line
126 Second arrow
127 First spring
128 Third arrow
129 Second spring
130 Second control position
131 Third control position
132 Fourth control position
133 Late stop
140 First control position
141 Valve housing
142 Control piston
143 Annular groove
144 Annular groove
145 Annular groove
146 First radial openings
146*a* Second radial openings
147 Second spring element
148 Tappet push rod
149 First limit stop
150 Second limit stop
151 First annular web
152 Second annular web
153 First control edge
154 Second control edge
155 Third control edge
156 Fourth control edge
157 Fourth annular groove
158 Third annular web
P Inlet port
T Outlet port
A First working port
B Second working port
$\phi$ Phase position
$\phi_{central}$ Locking phase position
X Amount
$Y_1$ Differential angle
$Y_2$ Differential angle
$Y_3$ Differential angle
$DF_{hold}$ Holding duty factor
$p_{min}$ Oil pressure

The invention claimed is:

1. A device (101) for altering the control times of gas exchange valves of an internal combustion engine, having a hydraulic actuating device (102), which has two oppositely acting pressure chambers (106, 107), it being possible for a phase position ($\phi$) of a camshaft relative to a crankshaft to be held or deliberately altered by feeding pressure medium to and discharging pressure medium from the pressure chambers (106, 107), and having a control valve (103) with two working ports (A, B), an outlet port (T) and an inlet port (P), the first working port (A) being in communication with the first pressure chamber (106), the second working port (B) being in communication with the second pressure chamber (107), and the outlet port (T) being in communication with a tank, and the inlet port (P) being supplied with pressure medium, the control valve (103) comprising a valve body (114) and an actuating unit (112), it being possible for the control valve (103) to be moved into a plurality of control positions (130, 131, 132, 140) by means of the actuating unit (112), the working ports (A, B) in each case being in communication either with the outlet port (T), the inlet port (P) or with neither of these two ports, depending on the control position (130, 131, 132, 140) of the control valve (103), characterized in that in a first control position (140) of the control valve (103), which corresponds to the control position with the actuating unit (112) unactivated, neither the first working port (A) nor the second working port (B) is in communication with the inlet port (P).

2. A device (101) of claim 1, wherein the hydraulic actuating device (102) has at least one locking pin (110, 111) and a slot guide (108, 109) in which the locking pin (110, 111) can engage in at least one position of the hydraulic actuating device (102) so as to be able to fix the phase position (ϕ) of the camshaft with respect to the crankshaft, and the hydraulic actuating device (102) being locked in a central position when the phase position (ϕ) is fixed.

3. A device (101) of claim 1, wherein the hydraulic actuating device has two locking pins (110, 111) and two slot guides (108, 109), it being possible for each locking pin (110, 111) to engage in one of the slot guides (108, 109) in at least one position of the hydraulic actuating device (102), the phase position (ϕ) of the camshaft being fixed with respect to the crankshaft when both locking pins (110, 111) are engaging in the respective slot guide (108, 109), and the hydraulic actuating device (102) being locked in a central position when the phase position (ϕ) is fixed.

4. A device (101) of claim 1, wherein in the first control position (140), which corresponds to the control position with the actuating unit (112) unactivated, neither working port (A, B) or one working port (A, B) or both working ports (A, B) are connected to the outlet port (T).

5. A device (101) of claim 1, wherein the valve body (114) comprises a hollow valve housing (141) and a control piston (142) arranged displaceably therein, it being possible for the actuating unit (112) to move the control piston (142) within the valve housing (141) into any desired position between two limit stops (149, 150) and to hold it in that position.

6. A device (101) of claim 1, wherein the control valve (103) can be moved into four control positions (130, 131, 132, 140) by means of the actuating unit (112).

7. A device (101) of claim 6, wherein in a first control position (140) of the control valve (103), which corresponds to the control position with the actuating unit (112) unactivated, the first working port (A) is in communication with the outlet port (T) and the second working port (B) is not in communication either with the outlet port (T) or with the inlet port (P), in a second control position (130) of the control valve (103) the first working port (A) is in communication with the outlet port (T) and the second working port (B) is in communication with the inlet port (P), in a third control position (131) of the control valve (103) the first and second working ports (A, B) are in communication neither with the outlet port (T) nor with the inlet port (P), in a fourth control position (132) of the control valve (103) the second working port (B) is in communication with the outlet port (T) and the first working port (A) is in communication with the inlet port (P).

8. A device (101) of claim 6, wherein in a first control position (140) of the control valve (103), which corresponds to the control position with the actuating unit (112) unactivated, the first working port (A) is in communication with the outlet port (T) and the second working port (B) is in communication neither with the outlet port (T) nor with the inlet port (P), in a second control position (130) of the control valve (103) the first working port (A) is in communication with the outlet port (T) and the second working port (B) is in communication with the inlet port (P), in a third control position (131) of the control valve (103) the first and second working ports (A, B) are in communication with the inlet port (P), in a fourth control position (132) of the control valve (103) the second working port (B) is in communication with the outlet port (T) and the first working port (A) is in communication with the inlet port (P).

9. A device (101) for altering the control times of gas exchange valves of an internal combustion engine, having a hydraulic actuating device (102), which has two oppositely acting pressure chambers (106, 107), it being possible for a phase position (ϕ) of a camshaft relative to a crankshaft to be held or deliberately altered by feeding pressure medium to and discharging pressure medium from the pressure chambers (106, 107), and having a control valve (103) with two working ports (A, B), an outlet port (T) and an inlet port (P), the first working port (A) being in communication with the first pressure chamber (106), the second working port (B) being in communication with the second pressure chamber (107), and the outlet port (T) being in communication with a tank, and the inlet port (P) being supplied with pressure medium, the control valve (103) comprising a valve body (114) and an actuating unit (112), it being possible for the control valve (103) to be moved into a plurality of control positions (130, 131, 132, 140) by means of the actuating unit (112), the working ports (A, B) in each case being in communication either with the outlet port (T), the inlet port (P) or with neither of these two ports, depending on the control position (130, 131, 132, 140) of the control valve (103), characterized inthat the control valve (103) can adopt four control positions (130, 131, 132, 140), in which case in a first control position (140) of the control valve (103) the volumetric flow from the inlet port (P) to one of the two pressure chambers (106, 107) is equal to zero, in a second control position (130) of the control valve (103) the volumetric flow from the inlet port (P) to one of the two pressure chambers (106, 107) is greater than zero, in a third control position (131) of the control valve (103) the volumetric flow from the inlet port (P) to one of the two pressure chambers (106, 107) is approximately zero, in a fourth control position (132) of the control valve (103) the volumetric flow from the inlet port (P) to one of the two pressure chambers (106, 107) is greater than zero.

10. A device (101) for altering the control times of gas exchange valves of an internal combustion engine, having a hydraulic actuating device which has two oppositely acting pressure chambers (106, 107), it being possible for a phase position (ϕ) of a camshaft relative to a crankshaft to be held or deliberately altered by feeding pressure medium to and discharging pressure medium from the pressure chambers (106, 107), and having a control valve (103) with two working ports (A, B), an outlet port (T) and an inlet port (P), the first working port (A) being in communication with the first pressure chamber (106), the second working port (B) being in communication with the second pressure chamber (107), and the outlet port (T) being in communication with a tank, and the inlet port (P) being supplied with pressure medium, the control valve (103) comprising a valve housing (141), which is of substantially hollow-cylindrical design, and a control piston (142), which is arranged displaceably within the valve housing (141), with a substantially cylindrical outer lateral surface, and an actuating unit (112), it being possible for the actuating unit (112) to move the control piston (142) within the valve housing (141) into any desired position between two limit stops (149, 150) and to hold it in that position, the working ports (A, B) each being in communication either with the outlet port (T), the inlet port (P) or with neither of these two ports, depending on the position of the control piston (142) relative to the valve housing (141), the working ports (A, B) and the inlet port (P) being designed as annular grooves (143, 144, 145) which are axially spaced apart from one another in the outer lateral surface of the valve housing (141), the annular grooves (143, 144, 145) being in communication, via first radial openings (146), with the interior of the valve housing (141), the control piston (142) being provided on its outer lateral surface with a first annular web (151) and a second annular web (152) which is at an axial distance from the first annular web (151), the external diameter of the annual webs (151, 152) being matched to the internal diameter of the valve housing (141), control edges (153, 154) formed on the first annular web (151) opening or closing a connection between the second working port (B) and the outlet port (T) and inlet port (P) depending on the position of the control piston (142) relative to the valve housing (141), control edges (155, 156) formed on the second annular web (152) opening or closing a connection between the first working port (A) and the outlet port (T) and inlet port (P) depending on the position of the control piston (142) relative to the valve housing (141), characterized in that the control piston (142) is provided with a third annular web (158), the external diameter of which is matched to the internal diameter of the valve housing (141), and the external diameter of the control piston (142) between the annular webs (151, 152, 158) being smaller than the internal diameter of the valve housing (141), the third annular web (158) is designed and arranged on the control piston (142) in such a manner that it blocks the connection between the first working port (A) and the inlet port (B) when the control piston (142) adopts a position which lies between a position which it adopts when the actuating unit (112) is exerting the minimum possible force on it and a position $s_1$, whereas it does not block this connection in any other position of the control piston (142).

11. A device (101) of claim 10, wherein the control valve (103) is in the first control position (140) when a force between the minimum possible force $F_0$ and $F_1$ is exerted by the actuating unit (112) on the control piston (142), in that the control valve (103) is in the second control position (130) when a force between $F_1$ and $F_2$ is exerted by the actuating unit (112) on the control piston (142), in that the control valve (103) is in the third control position (131) when a force between $F_2$ and $F_3$ is exerted by the actuating unit (112) on the control piston (142), in that the control valve (103) is in the fourth control position (132) when a force between $F_3$ and $F_4$ is exerted by the actuating unit (112) on the control piston (142), where $F_0<F_1<F_2<F_3<F_4$.

12. A device (101) of claim 10, wherein the control valve (103) is in the first control position (140) when the control piston (142) has been displaced by a distance between 0 and $s_1$ relative to the position which it adopts when the actuating unit (112) is exerting the minimum possible force on the control piston (142), the control valve (103) is in the second control position (130) when the control piston (142) has been displaced a distance between $s_1$ and $s_2$ relative to the position which it adopts when the actuating unit (112) is exerting the minimum possible force on the control piston (142), the control valve (103) is in the third control position (131) when the control piston (142) has been displaced a distance between $s_2$ and $s_3$ relative to the position which it adopts when the actuating unit (112) is exerting the minimum possible force on the control piston (142), the control valve (103) is in the fourth control position (132) when the control piston (142) has been displaced a distance between $s_3$ and $s_4$ relative to the position which it adopts when the actuating unit (112) is exerting the minimum possible force on the control piston (142), where $0<s_1<s_2<s_3<s_4$.

13. A device (101) of claim 10, wherein the annular webs (151, 152, 158) are formed integrally with the control piston (142).

14. A device (101) of claim 10, wherein the annular webs (151, 152, 158) are separately produced sleeves and are non-positively, positively or cohesively connected or joined to the control piston (142).

15. A device (101) of claim 10, wherein the control piston (142) is substantially hollow-cylindrical in form.

* * * * *